United States Patent [19]

Henning

[11] Patent Number: 4,678,079

[45] Date of Patent: Jul. 7, 1987

[54] CONTAINER FOR HANGER-SUPPORTED GARMENTS

[75] Inventor: John C. Henning, Fairfield, Ohio

[73] Assignee: Product Investment Incorporated, Cincinnati, Ohio

[21] Appl. No.: 863,462

[22] Filed: May 15, 1986

[51] Int. Cl.[4] ..... B65D 85/18

[52] U.S. Cl. ..... 206/279; 206/284; 206/289; 229/52 B

[58] Field of Search ..... 206/278, 279, 284–287, 206/287.1, 288–292, 294, 295, 299; 229/52 B

[56] References Cited

U.S. PATENT DOCUMENTS

| | | | |
|---|---|---|---|
| 1,626,381 | 4/1927 | Batts | 206/291 |
| 1,682,273 | 8/1928 | Fuller | 206/284 |
| 2,007,810 | 7/1935 | Oman | 229/52 B |
| 2,631,720 | 3/1953 | Rubin . | |
| 4,060,169 | 11/1977 | Hildebrand et al. . | |
| 4,085,842 | 4/1978 | Beck . | |
| 4,098,399 | 7/1978 | Bethune et al. . | |
| 4,119,197 | 10/1978 | Pilz . | |
| 4,318,472 | 3/1982 | Nauheimer et al. . | |

*Primary Examiner*—William Price
*Assistant Examiner*—Jimmy G. Foster
*Attorney, Agent, or Firm*—Wood, Herron & Evans

[57] ABSTRACT

A paper-board container is disclosed of the type used for shipping airline passengers' garment bags and other articles supported on hangers. The container includes a top wall and integral hanger. The hanger-support structure is formed in the top wall and includes a slot having an elongated leg parallel to the handle and a transverse leg. The flap of the top wall is foldable under the hanger hook which passes through an opening in the flap and is received in an opening in the top wall. The flap includes ears which are locked in a second opening of the top wall. In a modified version, the flap does not include an opening for receiving the hanger hook ears for locking the flap in place.

16 Claims, 5 Drawing Figures

CONTAINER FOR HANGER-SUPPORTED GARMENTS

BACKGROUND OF THE INVENTION

The present invention relates to foldable paper-board containers of the type utilized to transport articles carried by a hanger. The present invention is particularly directed to containers of the type having an integral handle at the top of the container.

At the present time, it is common for airlines to provide passengers with paper-board cartons for shipping passengers' garment bags and similar articles having suspension hooks. Such containers conventionally incorporate integral flaps extending above the top wall which flaps have hand receiving openings for carrying the container. The walls and handle flaps are held in assembled relationship by means of interlocking tabs. When using such containers, a garment bag or the like is inserted through the open upper end of the container and the hanger hook is rotated 90° and inserted through an opening formed at the top of the front wall of the container. Thereafter, the top of the container is closed and is secured in position by means of interlocking tabs formed on the side wall and handle flaps. While such containers facilitate handling of garment bags and provides some protection, thereto, they are nevertheless subject to several disadvantages.

In the first place, the openings through which the hangers are inserted tend to tear and the hangers tend to become disengaged with the result that the garment bag drops to the bottom of the container thus providing rumples and creases in the clothing being transported.

The second disadvantage is that the box is somewhat difficult to use with certain types of hangers since the hanger hook must be rotated 90° from its normal orientation in order to insert the hook in the wall opening.

A third disadvantage of prior art containers of the type described is that the load is concentrated at the top of the side wall and is transmitted to the handle primarily through the locking tabs. This has resulted in tearing of these tabs.

SUMMARY OF THE INVENTION

The present invention is directed to a novel hanger-support structure for use in containers of the type described as well as other types of containers for shipping hanger-supported articles.

The principal objective of the present invention is to provide a paper-board container for transporting hanger-supported articles which will avoid the disadvantages of prior art cartons without increasing the cost of the conventional cartons now in use. More particularly, it is an object of the present invention to provide a carton in which the garment and hanger can easily be inserted and thereafter locked in position to prevent accidental dislodgement.

It is a further objective of the present invention to provide a hanger-support structure for a container which facilitates insertion of the hanger without rotating the hook.

It is a still further objective of the present invention to provide a hanger structure which minimizes the tendency of the container to tear either in the area of the hanger-support structure or in the area of the locking tabs for securing the handle in position.

More particularly, the present invention is predicated in part upon the concept of providing a hanger support structure formed in the top wall of the container so that the hanger is carried by the top wall relatively close to the hanger. The hanger support structure of this invention includes a slot having an elongated leg of sufficient length so that the hook of the hanger can be inserted upwardly. The slot also includes an interconnecting transverse leg into which the hook can be shifted. In a preferred form, the hanger-support structure also includes a flap integral with the top wall and foldable upwardly and then downwardly toward the slot. The flap includes an opening through which the hanger hook can be passed and ears for locking the flap in its overfolded position by inserting the ears in a second opening formed in the top panel of the container. In this position, the flap lies under the hook with the free end of the hook extending into the opening formed by folding the flap. As a result the flap functions to reinforce the portion of the top wall which supports the hook and also functions to lock the hook so that the hanger can not become accidentally dislodged.

One of the principal advantages of the present container is that the hanger is easily inserted in the support structure without rotating the hook and yet once inserted is securely locked in position.

Another advantage of the present invention is that the load of the garment bag or the like is supported close to the handle and is transmitted directly to the handle through the top wall, substantially reducing the load on the handle locking flaps.

A still further advantage of the present invention is that the tendency of the top wall supporting the hanger to tear is minimized. As a result, once a garment bag or the like has been placed in a container of the present invention, it remains in position with the garments properly supported until the garment bag is removed at the passenger's destination.

These and other objectives and advantages of the present invention will be more readily apparent from a consideration of the following detailed description of the drawings illustrating a preferred and alternate embodiment of the present invention.

DETAILED DESCRIPTION OF THE DRAWINGS

Figure 1:
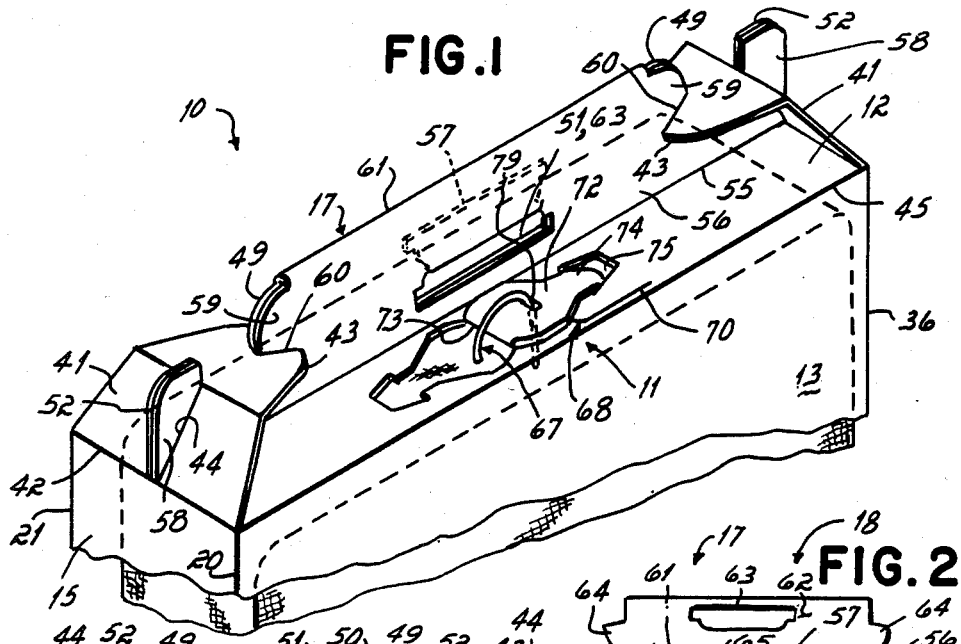
FIG. 1 is a perspective view of the upper end of a preferred form of container embodying the present invention.
Figure 2:
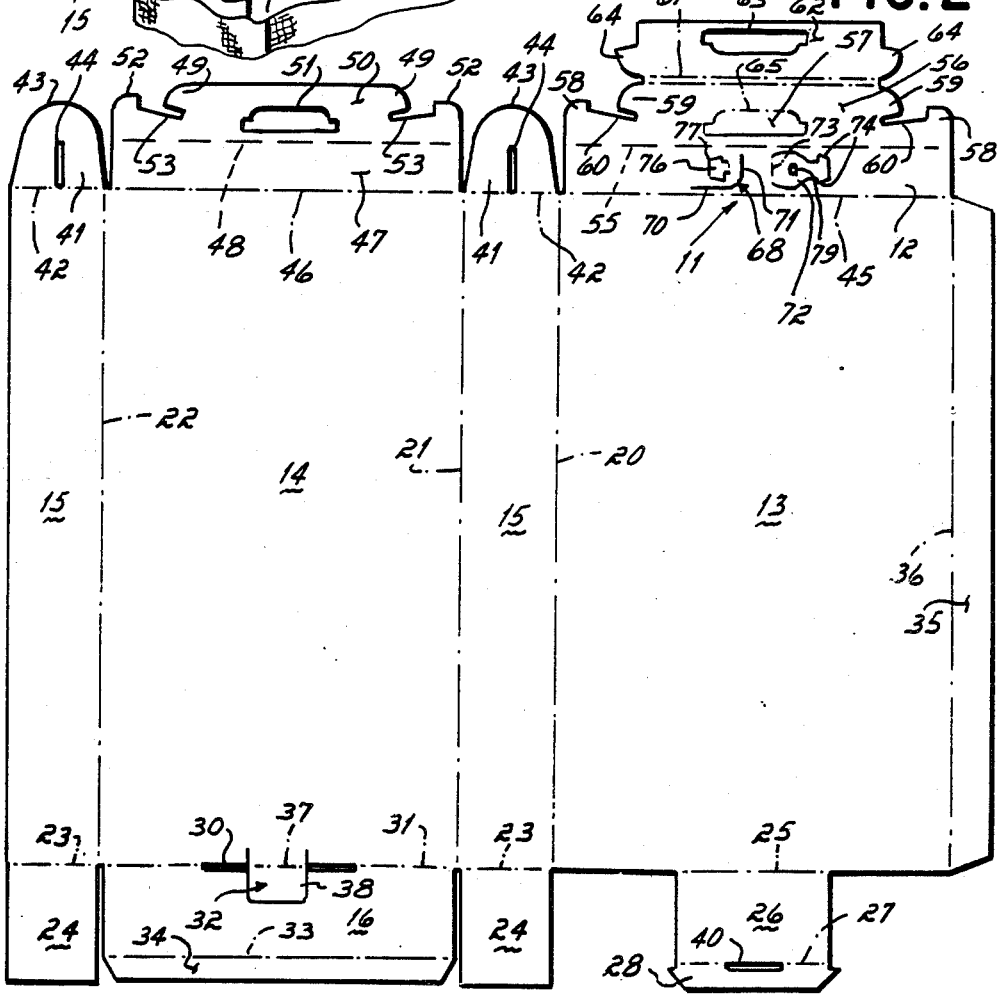
FIG. 2 is a top plan view of one form of blank used to form the container of FIG. 1.

FIG. 1 illustrates the upper end of a preferred form of container 10 embodying the present invention. Certain parts of container 10 not shown in FIG. 1 are illustrated in FIG. 2 which shows one form of blank for making the container. Container 10 is, except for the hanger-support structure 11 incorporated in the top wall panel 12, of a generally conventional construction commonly utilized by airlines for the shipment of garment bags and the like. More particularly, the container 10 includes a rectangular front wall 13 and a rectangular rear wall 14. The front and rear walls are interconnected by narrow side walls 15. The container also includes a bottom wall 16 and a support handle 17.

One suitable blank 18 for forming container 10 is illustrated in FIG. 2. It is to be understood, however, that the precise manner of forming the front, side, rear, and bottom walls of the container constitute no part of the present invention and that other blanks for forming these components and for forming handle portion 17 can be utilized in conjunction with the hanger-support structure 11 of the present invention.

As there shown in FIG. 2, a preferred form blank 18 includes large rectangular panels corresponding to front and rear walls 13 and 14. These panels are separated by a first side wall panel 15 defined by fold lines 20 and 21. A fold line 22 separates rear panel 14 from a second endwise panel defining a second side wall 15. Each of the panels forming side walls 15 has a transverse fold line 23 defining an endwise tab 24. A fold line 25 separates front panel 13 from a bottom flap 26. Bottom flap 26 has a transverse fold line 27 which forms an endwise tab 28. As explained below, tab 28 is adapted to be folded upwardly and inserted through a slot 30 formed in a fold line 31 extending along the bottom edge of rear panel 14.

Rear panel 14 also has a generally "U"-shaped cut forming a locking tab 32. A panel corresponding to bottom wall 16 extends outwardly from fold line 31. This panel has a fold line 33 forming a flap 34 adapted to be turned upwardly in abutment with the inner wall of front panel 13. Container 10 also includes a flap 35 separated from front wall 13 by a fold line 36. To assemble the lower portion of the box, front and rear panels 13 and 14 are respectively folded at right angles relative to panel 15 along lines 20 and 21. The second side wall 15 is folded at right angles to rear panel 14 along fold line 22. Narrow flap 35 is folded at right angles to front wall 13 and is positioned adjacent to the inner surface of side wall 15. Flap 35 and side wall 15 are joined together by means of a suitable adhesive or the like.

Tabs 24 are folded inwardly at right angles to side walls 15. These tabs lie between the front and rear walls 13 and 14. Bottom wall 16 is folded at right angles to rear wall 14 along fold line 31. Bottom flap 26 is folded across the bottom wall and its endwise flap 28 is folded upwardly and inserted through slot 30. This flap is locked in place by means of locking tab 32. Tab 32 is preferably provided with a fold line 37 in alignment with the edge of slot 30. The portion of this tab 38 extending below the fold line in FIG. 2 is inserted in a transverse slot 40 formed in bottom tab 26 to secure the front, rear, side, and bottom walls of the container in assembled relationship.

The upper portion of the container includes upper tabs 41 formed on the ends of side walls 15 and joined thereto at fold lines 42. Each of the tabs 41 preferably has a curved outer end 43 and a slot 44 extending parallel to fold line 21 and 22. Front wall 13 is joined to top wall panel 12 by means of a fold line 45. A similar fold line 46 joins rear wall 14 to a second top wall panel 47. Fold line 48 parallel to fold line 46 separates top wall panel 47 from a handle section 50. Handle section 50 includes a handle receiving opening 51, upstanding end tabs 52, horizontal tabs 49, and inwardly extending sloping slots 53.

A fold line 55 parallel to fold line 45 separates top wall panel 12 from a handle section 56. Handle section 56 includes a cut forming the handle lock tab 57, endwise upstanding tabs 58, horizontal tabs 59, and slots 60. Tab 57 is bendable along fold line 65 to form a hand opening in section 56. Another fold line 61 parallel to fold line 55 separates handle section 56 from a third handle section 62. Handle section 62 is configurated to form handle receiving opening 63 and outwardly extending curved tabs 64.

The upper section of the container in a closed condition is shown in FIG. 1. To close the container, top wall panel 47 is folded inwardly along line 46 and handle portion 50 is bent upwardly along fold line 48. Top wall section 12 is folded inwardly along fold line 45 and handle portion 56 is bent upwardly along fold line 55 to bring sections 56 and 50 into abutment. Handle section 62 is then bent downwardly over sections 56 and 50 and handle lock tab 57 is inserted through openings 51 and 63 and locks the handle sections together. End tabs 41 are folded inwardly with upstanding end tabs 52 and 58 extending through slots 44. The ends 43 of tabs 41 are inserted in slots 53 and 60 to complete the assembly of the container. While it is to be understood that the handle construction described above is generally conventional, it differs slightly from the handle construction now in widespread use. More particularly, the present-day handle constructions include four handle sections with a fourth section (not shown) being formed on top of handle section 50. This fourth handle section would be similar in construction to handle section 62. In this commonly employed handle construction, the two outermost handle sections are bent downwardly and are brought into facial abutment when the box is assembled. It is to be understood, however, that the construction of the handle constitutes no part of the present invention and that the hanger-support means 11 can be provided in a container using either type handle.

Figure 3:
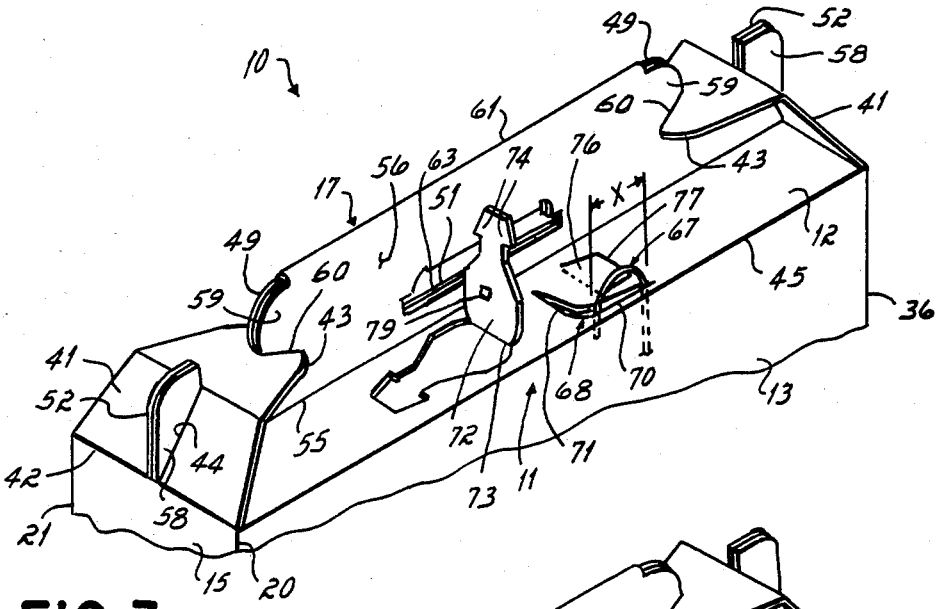
FIG. 3 is a perspective view of container of FIG. 1 showing the manner in which a hanger is inserted through the slot prior to engagement with the tab.

As indicated above, all of the components of container 10 except for hanger-support means 11 are generally conventional. The details of hanger-support means 11 are best shown in FIGS. 1, 2, and 3. These means are adapted to support a hanger 67 from top wall 12. It is to be understood that hanger 67 may carry a garment bag or other article which hangs downwardly within the interior of container 10.

Hanger-support means 11 comprises a generally "L"-shaped slot 68. Slot 68 includes elongated leg 70 which preferably extends substantially parallel to front wall 13 and a transverse leg 71 which extends generally parallel to end walls 15. Legs 70 and 71 are preferably joined by a curved section to facilitate movement of the neck of hanger 67 from leg 70 to transverse leg 71 of the slot. Slot section 70 is longer than the overall length of the "U"-shaped hook portion of the hanger (dimension "x" in FIG. 3). Thus, the hanger can be inserted upwardly through elongated leg 70 and then shifted along the slot until the hanger is located in the transverse segment 71 of the slot.

The hanger-support structure 11 further comprises a first flap 72 defined by a first opening cut in top wall 12, the flap being joined to the top wall along a fold line 73. Flap 72 is provided with an opening 79 adapted to receive the hook of hanger 67 as shown in FIG. 1. Flap 72 is also configurated to form two laterally extending ears 74. Ears 74 are adapted to be inserted in a second opening 75 formed in top panel 12 on the opposite side of the transverse leg 71 from flap 72. Opening 75 is preferably formed by depressing a tab 76 downwardly. Tab 76 is defined by a cut 77 with tab being joined to panel 12 in an area between the two spaced ends of the cut. It is to be understood that while any one hanger-support structure 11 is shown, a second identical structure can be formed in panel 47 if desired.

In use, the lower front, rear, and side walls and bottom are folded, and secured as described above with the top of the container remaining open. A garment bag or other hanger-supported article is then placed within the container and handle section 12 is bent inwardly. The hanger is extended upwardly through elongated leg 70 of the slot and is, as shown in FIG. 3, then manipulated into the shorter transverse leg 71 of the slot. Thereafter, flap 72 is folded downwardly with the end of the hanger extending through an opening 79 in flap 72 as shown in FIG. 1. Flap 72 is then secured in position by inserting ears 74 in a second opening 75. Thereafter, the remaining elements of the top portion of the container are assembled as explained previously. When the container is either carried by handle 17 or shipped on its side, hanger 67 is locked in position relatively close to the juncture of the handle and top wall. This is advantageous because the hanger cannot become dislodged accidentally allowing garments to drop to the bottom of the container. Moreover, the load is transferred to the handle directly reducing the load on the box locking flaps 41.

Figure 4:
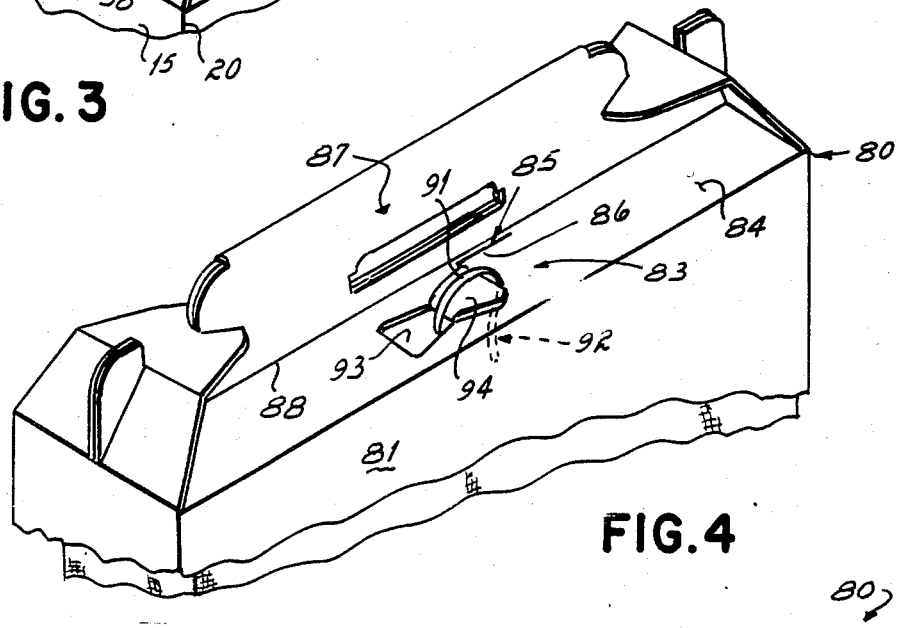
FIG. 4 is a perspective view similar to FIG. 1 of a modified form of container.
Figure 5:
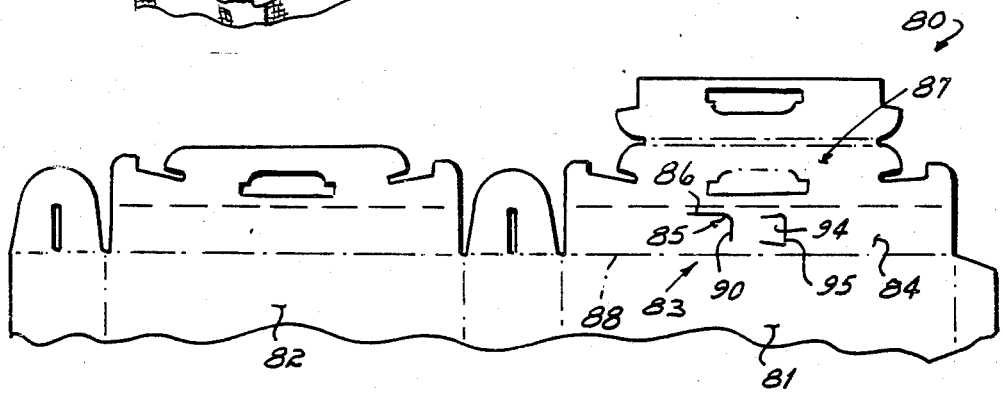
FIG. 5 is a partial top plan view of a preferred form of blank for forming the container of FIG. 4.

A modified form of container 80 which is simpler than the preferred embodiment is shown in FIGS. 4 and 5. The modified form of container does not provide the full positive hanger locking action provided by the preferred form of container but does, nevertheless, substantially reduce the possibility that the hanger will be dislodged accidentally and otherwise provides the other advantages of the preferred embodiment. More particularly, modified container 80 includes a rectangular front wall 81 and rear wall 82 identical with front and rear walls 13 and 14. Indeed it is to be understood that except for the hanger-support structure modified container 80 is identical with preferred form of container 10.

The modified support structure 83, shown in FIGS. 4 and 5, is formed in a top panel 84 of the container which corresponds to panel 12 of the preferred embodiment. Modified hanger-support structure 83 includes a generally "L"-shaped slot 85 of the same configuration as slot 68 of the preferred embodiment. However, in the modified hanger structure 83, elongated leg 86 of the slot extends parallel to handle section 87 and is located closely adjacent to fold line 88 which separates that handle section from panel 84. Elongated section 86 of slot 83 is preferably joined by a curved portion to transverse slot leg 90. As in the preferred embodiment, elongated leg 86 of the slot is preferably longer than the length of the hook 91 of hanger 92 so that the hanger can be inserted upwardly through slot 86 and thereafter, shifted along the curved section of the slot into registry with transverse leg 90.

In addition to slot 85, hanger-support structure 83 includes an opening 93 formed by bending tab 94 upwardly. Tab 94 is defined by a generally "U"-shaped cut 95. The tab is joined to top panel 84 between the open ends of the cut and is foldable upwardly along a transverse line between these ends.

In use, the box is assembled with the top left open in the same manner as explained previously in connection with the preferred form of container. Thereafter, a garment bag or other article mounted upon hanger 92 is placed within the container and hook 91 of the hanger is inserted upwardly through elongated leg 86 and slot 85. The hook is then shifted into engagement with transverse leg 90 of the slot and is allowed to drop downwardly over folded flap 94 with the end of the hook extending through opening 93 as shown in FIG. 4. It will be appreciated that while the hanger is not positively locked in this position, it is difficult to accidentally dislodge the hanger, since such dislodgement would require raising the hanger to dislodge the hook from opening 93 and shifting the hanger along the transverse leg of the slot to registry with the elongated leg of the slot. Aside from the lack of positive lock, however, the modified hanger-support structure provides the other advantages of the preferred form of hanger support.

From the above disclosure of the general principles of the present invention and the above description of two embodiments, those skilled in the art will readily comprehend various modifications to which the invention is susceptible. Thus, for example, while the hanger-support structure is most advantageous for use with containers of the type having handle carrying means, the hanger-support structure also provides some advantages, e.g., locking the hanger against accidental dislodgment when used with boxes without handles. Accordingly, I desire to be limited only by the scope of the following claims.

I claim:

1. In a paper-board container for transporting articles supported from a hanger, said container comprising a top wall and handle means associated with the top wall, the improvement comprising a hanger-support structure found in said top wall and comprising a slot having an elongated leg and a transverse leg extending at an angle to said elongated leg, a flap in the top wall adjacent said slot, and an opening in said top wall disposed on the side of said flap remote from said slot, the slot being adapted to receive the hook of said hanger, the flap being foldable under said hook and the opening being adapted to receive the end of said hook.

2. The container of claim 1 in which said elongated leg of the slot is longer than the length of the hook of said hanger whereby said hook can be inserted through said elongated leg and then shifted into registry with said transverse leg.

3. The container of claim 2 in which said elongated slot extends parallel to said handle means.

4. In a paper-board container for transporting articles supported from a hanger, said container comprising a top wall and handle means associated with the top wall, the improvement comprising a hanger-support structure comprising a slot having an elongated leg and a transverse leg extending at an angle to said elongated leg, a flap in the top wall adjacent said slot, a first opening in said top wall disposed on the side of said flap remote from said slot, a second opening formed in said top wall adjacent said slot, said slot being adapted to receive the hook of said hanger, said flap being foldable under said hook and having an opening adapted to receive said hook, said flap further comprising an ear adapted to be received within said second opening for locking the end of said flap therein, said first opening being adapted to receive the end of said hook.

5. The container of claim 4 in which said elongated leg of said slot is longer than the length of the hook of said hanger whereby said hook can be inserted through said elongated leg and then shifted into registry with said transverse leg.

6. The container of claim 5 in which said elongated slot extends parallel to said handle means.

7. A paper-board container for transporting articles supported from a hanger said container comprising a rectangular front and rear wall, narrow side walls joining the front and rear walls, a bottom wall, a top wall section formed integral with one of said front and rear walls, a handle member formed integral with said top wall section and flap means for securing said handle member in assembled relationship with said front, rear, and side walls, said handle member extending parallel to said front and rear walls, a hanger-support structure comprising a slot formed in said top wall section having an elongated leg and a transverse leg extending at an angle to said elongated leg, a flap formed in the top wall adjacent said slot, and an opening in said top wall disposed on the side of said flap remote from said slot, the slot being adapted to receive the hook of said hanger, the flap being foldable under said hook and the opening being adapted to receive the end of said hook.

8. The container of claim 7 in which said elongated leg of the slot is longer than the length of the hook of said hanger whereby said hook can be inserted through said elongated leg and then shifted into registry with said transverse leg.

9. The container of claim 8 in which said elongated slot extends parallel to said handle means.

10. A paper-board container for transporting articles supported from a hanger said container comprising a rectangular front and rear wall, narrow side walls joining the front and rear walls, a bottom wall, a top wall section formed integral with one of said front and rear walls, a handle member formed integral with said top wall section and flap means for securing said handle member in assembled relationship with said front, rear, and side walls, said handle member extending parallel to said front and rear walls, a hanger-support structure comprising a slot formed in said top wall section having an elongated leg and a transverse leg extending at an angle to said elongated leg, a flap formed in the top wall adjacent said slot, a first opening in said top wall disposed on the side of said flap remote from said slot, a second opening formed in said top wall adjacent said slot, said slot being adapted to receive the hook of said hanger, said flap being foldable under said hook and having an opening adapted to receive said hook, said flap further comprising an ear adapted to be received within said second opening for locking the end of said flap therein, said first opening being adapted to receive the end of said hook.

11. The container of claim 10 in which said elongated leg of said slot is longer than the length of the hook of said hanger whereby said hook can be inserted through said elongated leg and then shifted into registry with said transverse leg.

12. The container of claim 11 in which said elongated slot extends parallel to said handle.

13. A paper-board container for transporting articles supported from a hanger said container comprising a rectangular front and rear wall, side walls joining the front and rear walls, a bottom wall, a top wall, a hanger-support structure comprising a slot formed in said top wall section having an elongated leg and a transverse leg extending at an angle to said elongated leg, a flap formed in the top wall adjacent said slot, and an opening in said top wall disposed on the side of said flap remote from said slot, the slot being adapted to receive the hook of said hanger, the flap being foldable under said hook and the opening being adapted to receive the end of said hook.

14. The container of claim 13 in which said elongated leg of the slot is longer than the length of the hook of said hanger whereby said hook can be inserted through said elongated leg and then shifted into registry with said transverse leg.

15. A paper-board container for transporting articles supported from a hanger said container comprising a rectangular front and rear wall, side walls joining the front and rear walls, a bottom wall, a top wall, a hanger-support structure comprising a slot formed in said top wall having an elongated leg and a transverse leg extending at an angle to said elongated leg, a flap in the top wall adjacent said slot, a first opening in said top wall disposed on the side of said flap remote from said slot, a second opening formed in said top wall adjacent said slot, said slot being adapted to receive the hook of said hanger, said flap being foldable under said hook and having an opening adapted to receive said hook, said flap further comprising an ear adapted to be received within said second opening for locking the end of said flap therein, said first opening being adapted to receive the end of said hook.

16. The container of claim 15 in which said elongated leg of said slot is longer than the length of the hook of said hanger whereby said hook can be inserted through said elongated leg and then shifted into registry with said transverse leg.

* * * * *